US008844165B2

(12) United States Patent
Gishifu et al.

(10) Patent No.: US 8,844,165 B2
(45) Date of Patent: Sep. 30, 2014

(54) ADJUSTABLE BLADDER SYSTEM WITH EXTERNAL VALVE FOR AN ARTICLE OF FOOTWEAR

(75) Inventors: Amy E. Gishifu, Vancouver, WA (US); Elizabeth Langvin, Sherwood, OR (US); James Molyneux, Portland, OR (US); Lee D. Peyton, Tigard, OR (US); Ty A. Ransom, Portland, OR (US); Nicola J. Reynolds, Hillsboro, OR (US); John F. Swigart, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 722 days.

(21) Appl. No.: 13/081,079

(22) Filed: Apr. 6, 2011

(65) Prior Publication Data

US 2012/0255197 A1 Oct. 11, 2012

(51) Int. Cl.
*A43B 13/20* (2006.01)
*A43B 7/14* (2006.01)

(52) U.S. Cl.
CPC ..... *A43B 7/148* (2013.01); *A43B 13/203* (2013.01)
USPC ..... 36/29; 36/35 B; 36/37

(58) Field of Classification Search
CPC ..... A43B 13/18; A43B 13/189; A43B 13/20; A43B 13/203; A43B 21/26; A43B 21/265; A43B 21/28; A43B 21/285
USPC ..... 36/29, 35 B, 37
See application file for complete search history.

(56) References Cited

U.S. PATENT DOCUMENTS

| | | | | | |
|---|---|---|---|---|---|
| 510,504 | A | * | 12/1893 | Foster | 36/29 |
| 572,887 | A | * | 12/1896 | Gallagher | 36/17 R |
| 586,155 | A | * | 7/1897 | Bascom | 36/29 |
| 1,010,187 | A | * | 11/1911 | Scott | 36/29 |
| 1,011,460 | A | | 12/1911 | Maddocks | |
| 1,069,001 | A | | 7/1913 | Guy | |
| 1,304,915 | A | * | 5/1919 | Spinney | 36/29 |
| 1,498,838 | A | | 6/1924 | Harrison, Jr. | |
| 1,557,947 | A | * | 10/1925 | Stewart | 36/153 |
| 2,007,803 | A | * | 7/1935 | Kelly | 251/357 |
| 2,109,180 | A | * | 2/1938 | Mohun | 36/29 |
| 3,721,265 | A | | 3/1973 | Hoffland | |
| 4,129,951 | A | | 12/1978 | Petrosky | |
| 4,183,156 | A | | 1/1980 | Rudy | |

(Continued)

FOREIGN PATENT DOCUMENTS

| | | |
|---|---|---|
| DE | 2855268 | 7/1980 |
| FR | 2801174 | 5/2001 |

(Continued)

OTHER PUBLICATIONS

International Preliminary Report on Patentability (including Written Opinion of the ISA) mailed Oct. 17, 2013 in International Application No. PCT/US2012/030726.

(Continued)

*Primary Examiner* — Marie Bays
(74) *Attorney, Agent, or Firm* — Plumsea Law Group, LLC

(57) ABSTRACT

An adjustable bladder system for an article of footwear is disclosed. The bladder system includes an outer bladder that may be inflated using an external pump. A valve member may be disposed externally to the outer bladder. In addition, one or more tensile members may be disposed within the outer bladder to control deformation of the outer bladder during compression.

36 Claims, 12 Drawing Sheets

(56) References Cited

U.S. PATENT DOCUMENTS

| | | | |
|---|---|---|---|
| 4,219,945 | A | 9/1980 | Rudy |
| 4,237,625 | A | 12/1980 | Cole et al. |
| 4,358,902 | A | 11/1982 | Cole et al. |
| 4,657,716 | A | 4/1987 | Schmidt |
| 4,670,995 | A | 6/1987 | Huang |
| 4,712,316 | A | 12/1987 | Baggio |
| 4,722,131 | A | 2/1988 | Huang |
| 4,763,426 | A | 8/1988 | Polus et al. |
| 4,856,208 | A | 8/1989 | Zaccaro |
| 4,887,367 | A | 12/1989 | Mackness et al. |
| 4,912,861 | A | 4/1990 | Huang |
| 4,936,029 | A | 6/1990 | Rudy |
| 4,991,317 | A | 2/1991 | Lakic |
| 5,025,575 | A | 6/1991 | Lakic |
| 5,042,176 | A | 8/1991 | Rudy |
| 5,083,361 | A | 1/1992 | Rudy |
| 5,113,599 | A | 5/1992 | Cohen et al. |
| 5,144,708 | A | 9/1992 | Pekar |
| 5,179,792 | A | 1/1993 | Brantingham |
| 5,193,246 | A | 3/1993 | Huang |
| 5,199,191 | A | 4/1993 | Moumdjian |
| 5,224,278 | A | 7/1993 | Jeon |
| 5,228,156 | A | 7/1993 | Wang |
| 5,238,231 | A | 8/1993 | Huang |
| 5,295,313 | A | 3/1994 | Lee |
| 5,335,382 | A | 8/1994 | Huang |
| 5,351,710 | A | 10/1994 | Phillips |
| 5,355,552 | A | 10/1994 | Huang |
| 5,384,977 | A | 1/1995 | Chee |
| 5,406,661 | A | 4/1995 | Pekar |
| 5,558,395 | A | 9/1996 | Huang |
| 5,564,143 | A | 10/1996 | Pekar et al. |
| 5,588,227 | A | 12/1996 | Goldston et al. |
| 5,590,696 | A | 1/1997 | Phillips et al. |
| 5,598,645 | A | 2/1997 | Kaiser |
| 5,669,161 | A | 9/1997 | Huang |
| 5,713,141 | A | 2/1998 | Mitchell et al. |
| 5,740,619 | A | 4/1998 | Broder |
| 5,741,568 | A | 4/1998 | Rudy |
| 5,794,361 | A | 8/1998 | Sadler |
| 5,802,738 | A | 9/1998 | Ferniani |
| 5,802,739 | A | 9/1998 | Potter et al. |
| 5,813,142 | A | 9/1998 | Demon |
| 5,830,553 | A | 11/1998 | Huang |
| 5,846,063 | A | 12/1998 | Lakic |
| 5,902,660 | A | 5/1999 | Huang |
| 5,907,911 | A | 6/1999 | Huang |
| 5,918,383 | A | 7/1999 | Chee |
| 5,925,306 | A | 7/1999 | Huang |
| 5,937,462 | A | 8/1999 | Huang |
| 5,952,065 | A | 9/1999 | Mitchell et al. |
| 5,979,078 | A | 11/1999 | McLaughlin |
| 5,987,779 | A | 11/1999 | Litchfield et al. |
| 5,996,253 | A | 12/1999 | Spector |
| 6,013,340 | A | 1/2000 | Bonk et al. |
| 6,014,823 | A | 1/2000 | Lakic |
| 6,027,683 | A | 2/2000 | Huang |
| 6,065,150 | A | 5/2000 | Huang |
| 6,082,025 | A | 7/2000 | Bonk et al. |
| 6,119,371 | A | 9/2000 | Goodwin et al. |
| 6,127,010 | A | 10/2000 | Rudy |
| 6,127,026 | A | 10/2000 | Bonk et al. |
| 6,128,837 | A | 10/2000 | Huang |
| 6,134,812 | A | 10/2000 | Voss |
| 6,161,240 | A | 12/2000 | Huang |
| 6,170,173 | B1 | 1/2001 | Caston |
| 6,203,868 | B1 | 3/2001 | Bonk et al. |
| 6,282,815 | B1 | 9/2001 | Caston |
| 6,298,499 | B1 | 10/2001 | Huang |
| 6,305,102 | B1 | 10/2001 | Doyle |
| 6,314,663 | B1 | 11/2001 | Saldana |
| 6,321,465 | B1 | 11/2001 | Bonk et al. |
| 6,391,405 | B1 | 5/2002 | Bonk et al. |
| 6,428,865 | B1 | 8/2002 | Huang |
| 6,430,843 | B1 | 8/2002 | Potter et al. |
| 6,460,197 | B2 | 10/2002 | Huang |
| 6,510,624 | B1 | 1/2003 | Lakic |
| 6,519,873 | B1 | 2/2003 | Buttigieg |
| 6,537,639 | B1 | 3/2003 | Huang |
| 6,553,691 | B2 | 4/2003 | Huang |
| 6,557,271 | B1 | 5/2003 | Weaver, III |
| 6,571,490 | B2 | 6/2003 | Tawney et al. |
| 6,585,669 | B2 | 7/2003 | Manor et al. |
| 6,725,573 | B2 | 4/2004 | Doyle |
| 6,730,379 | B2 | 5/2004 | Bonk et al. |
| 6,773,785 | B1 | 8/2004 | Huang |
| 6,782,640 | B2 | 8/2004 | Westin |
| 6,785,985 | B2 | 9/2004 | Marvin et al. |
| 6,865,825 | B2 | 3/2005 | Bailey, Sr. et al. |
| 6,889,451 | B2 * | 5/2005 | Passke et al. ..... 36/29 |
| 6,915,594 | B2 | 7/2005 | Kim |
| 6,971,193 | B1 | 12/2005 | Potter et al. |
| 6,976,321 | B1 | 12/2005 | Lakic |
| 6,988,329 | B2 | 1/2006 | Marvin et al. |
| 7,017,285 | B2 * | 3/2006 | Lakic ..... 36/29 |
| 7,047,670 | B2 | 5/2006 | Marvin et al. |
| 7,051,456 | B2 | 5/2006 | Swigart et al. |
| 7,070,845 | B2 | 7/2006 | Thomas et al. |
| 7,107,706 | B1 | 9/2006 | Bailey, Sr. et al. |
| 7,131,218 | B2 | 11/2006 | Schindler |
| 7,152,625 | B2 | 12/2006 | Marvin et al. |
| 7,171,765 | B2 | 2/2007 | Lo |
| 7,204,041 | B1 | 4/2007 | Bailey, Sr. et al. |
| 7,244,483 | B2 | 7/2007 | Tawney et al. |
| 7,254,909 | B2 | 8/2007 | Ungari |
| 7,278,445 | B2 | 10/2007 | Marvin et al. |
| 7,337,560 | B2 | 3/2008 | Marvin et al. |
| 7,340,851 | B2 | 3/2008 | Litchfield et al. |
| 7,383,648 | B1 | 6/2008 | Litchfield et al. |
| 7,395,614 | B1 | 7/2008 | Bailey et al. |
| 7,395,615 | B2 | 7/2008 | Lee |
| 7,409,780 | B2 | 8/2008 | Marvin et al. |
| 7,448,150 | B1 * | 11/2008 | Davis et al. ..... 36/29 |
| 7,451,554 | B2 | 11/2008 | Hazenberg et al. |
| 7,451,555 | B1 | 11/2008 | Lakic |
| 7,478,488 | B1 | 1/2009 | Davis et al. |
| 7,784,196 | B1 | 8/2010 | Christensen et al. |
| 2002/0164257 | A1 | 11/2002 | Baek |
| 2002/0194747 | A1 | 12/2002 | Passke et al. |
| 2003/0098118 | A1 | 5/2003 | Rapaport |
| 2004/0010939 | A1 | 1/2004 | Liu et al. |
| 2004/0088882 | A1 | 5/2004 | Buttigieg |
| 2005/0039346 | A1 * | 2/2005 | Thomas et al. ..... 36/29 |
| 2005/0097777 | A1 * | 5/2005 | Goodwin ..... 36/29 |
| 2005/0183287 | A1 | 8/2005 | Schindler |
| 2005/0241185 | A1 | 11/2005 | Flood et al. |
| 2006/0174518 | A1 | 8/2006 | Fogarty et al. |
| 2006/0196081 | A1 | 9/2006 | Lee |
| 2006/0225304 | A1 | 10/2006 | Goodwin |
| 2008/0163517 | A1 | 7/2008 | Chen |
| 2008/0222916 | A1 | 9/2008 | Jin |
| 2009/0288312 | A1 | 11/2009 | Dua |
| 2009/0288313 | A1 | 11/2009 | Rapaport et al. |
| 2010/0242303 | A1 | 9/2010 | Callahan et al. |
| 2011/0067264 | A1 | 3/2011 | Doyle |

FOREIGN PATENT DOCUMENTS

| | | |
|---|---|---|
| WO | 8703789 | 7/1987 |
| WO | 9119430 | 12/1991 |
| WO | 9314659 | 8/1993 |
| WO | 0178539 | 10/2001 |
| WO | 2009027941 | 3/2009 |

OTHER PUBLICATIONS

International Search Report and Written Opinion mailed Oct. 19, 2012 in International Application No. PCT/US2012/030721.

International Search Report and Written Opinion mailed Oct. 22, 2012 in International Application No. PCT/US2012/030724.

International Search Report and Written Opinion mailed Oct. 25, 2012 in International Application No. PCT/US2012/030726.

International Search Report and Written Opinion mailed Oct. 26, 2012 in International Application No. PCT/US2012/030718.

(56) References Cited

OTHER PUBLICATIONS

International Preliminary Report on Patentability (including Written Opinion of the ISA) mailed Oct. 17, 2013 in International Application No. PCT/US2012/030718.

International Preliminary Report on Patentability (including Written Opinion of the ISA) mailed Oct. 17, 2013 in International Application No. PCT/US2012/030721.

International Preliminary Report on Patentability (including Written Opinion of the ISA) mailed Oct. 17, 2013 in International Application No. PCT/US2012/030724.

Office Action mailed Dec. 30, 2013 in U.S. Appl. No. 13/081,069.

Response to Written Opinion filed Apr. 28, 2014 in European Patent Application No. 12721619.0.

Response to Written Opinion filed Apr. 28, 2014 in European Patent Application No. 12719521.2.

Response to Written Opinion filed Apr. 8, 2014 in European Patent Application No. 12718765.6.

Response to Office Action filed Mar. 18, 2014 in U.S. Appl. No. 13/081,069.

Office Action mailed Mar. 20, 2014 in U.S. Appl. No. 13/081,058.

Observations and Voluntary Amendments filed May 6, 2014 in Chinese Patent Application No. 201280015874.3, and English translation thereof.

Office Action mailed May 23, 2014 in U.S. Appl. No. 13/081,091.

Observations and Voluntary Amendments filed Mar. 31, 2014 in Chinese Patent Application No. 201280017035.5, with English translation of the amended claims.

Observations and Voluntary Amendments filed May 16, 2014 in Chinese Patent Application No. 201280015447.5, and English translation thereof.

Amendment filed Jun. 4, 2014 in U.S. Appl. No. 13/081,058.

Amendment filed Aug. 19, 2014 in U.S. Appl. No. 13/081,091.

* cited by examiner

ADJUSTABLE BLADDER SYSTEM WITH EXTERNAL VALVE FOR AN ARTICLE OF FOOTWEAR

BACKGROUND

The present embodiments relate generally to an article of footwear, and in particular to an article of footwear with a bladder system.

Articles with bladders have been previously proposed. Some designs include a cushioning member that surrounds a reservoir. Other designs include a buffer air cushion that has an outer air cushion and an inner air cushion.

SUMMARY

In one aspect, a bladder system for an article of footwear includes an outer bladder bounding an interior cavity, the outer bladder including an upper layer and a lower layer and the lower layer including an outer surface facing outwardly from the interior cavity. The bladder system also includes a valve member including a housing, a valve, an outlet port and a fluid passage extending between the valve and the outlet port. The outer surface of the lower layer is attached to the valve member and a hole in the lower layer is aligned with the outlet port of the valve member.

In another aspect, a bladder system for an article of footwear includes an outer bladder bounding an interior cavity, where the outer bladder includes an upper layer and a lower layer. The lower layer includes an outer surface facing outwardly from the interior cavity. The bladder system also includes a stacked tensile member including a plurality of textile layers and a plurality of connecting members and a valve member configured to deliver fluid to the interior cavity. The stacked tensile member is disposed inside the interior cavity and the valve member is associated with the outer surface.

In another aspect, a method of making a bladder system includes attaching a first side of a lower layer to a valve member, where the valve member includes an outlet port. The method also includes forming a hole in the lower layer corresponding to the outlet port of the valve member, associating a tensile member with a second side of the lower layer, where the second side is disposed opposite of the first side. The method also includes associating an upper layer with the lower layer and attaching the upper layer and the lower layer in a manner that forms a pressurized interior cavity and enclosing the tensile member within the interior cavity.

In another aspect, a method of making a bladder system includes attaching a first side of a lower layer to a valve member, where the valve member includes a valve and an outlet port. The method also includes forming a hole in the lower layer corresponding to the outlet port of the valve member, associating an upper layer with the second side of the lower layer, joining a first periphery of the lower layer with a second periphery of the upper layer so as to form a pressurized interior cavity, where the valve member is disposed outside of the interior cavity.

In another aspect, a method of making a bladder system includes attaching a first side of a lower layer to a valve member, where the valve member includes a valve and an outlet port. The method also includes forming a hole in the lower layer corresponding to the outlet port of the valve member, associating a stacked tensile member with a second side of the lower layer that is disposed opposite of the first side, attaching a first textile layer of the tensile member to the lower layer, attaching an upper layer to a second textile layer of the tensile member and attaching the lower layer and the upper layer in a manner that forms a pressurized interior cavity so that the stacked tensile member is disposed inside the interior cavity.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
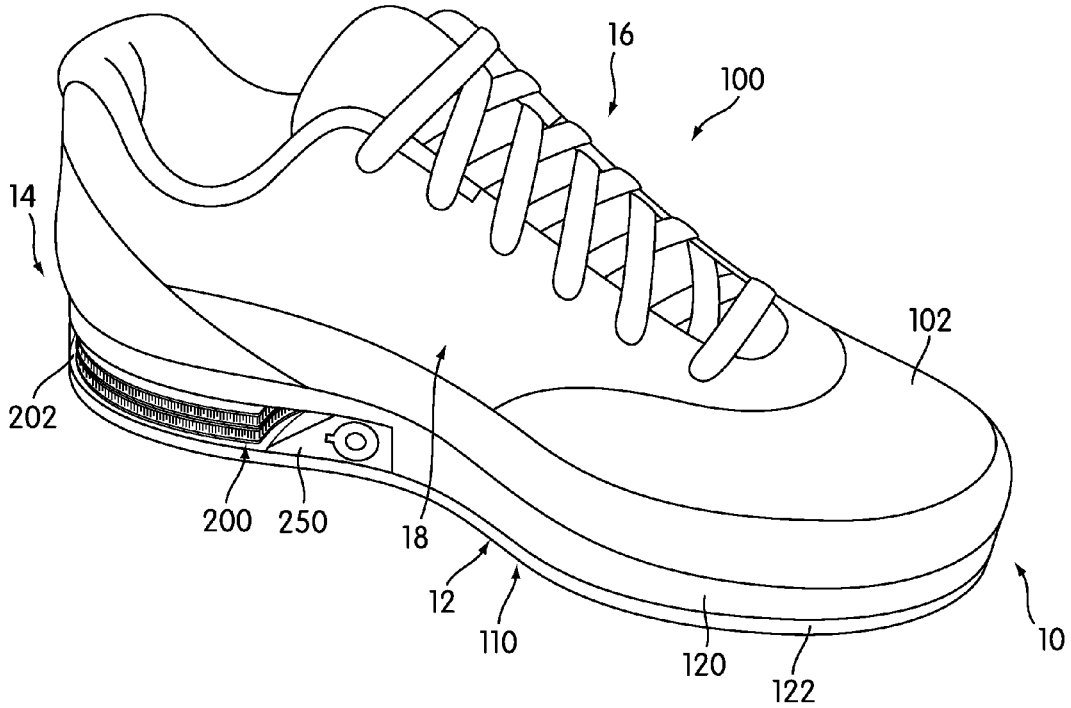
FIG. 1 is an isometric view of an embodiment of an article of footwear with a bladder system.
Figure 2:
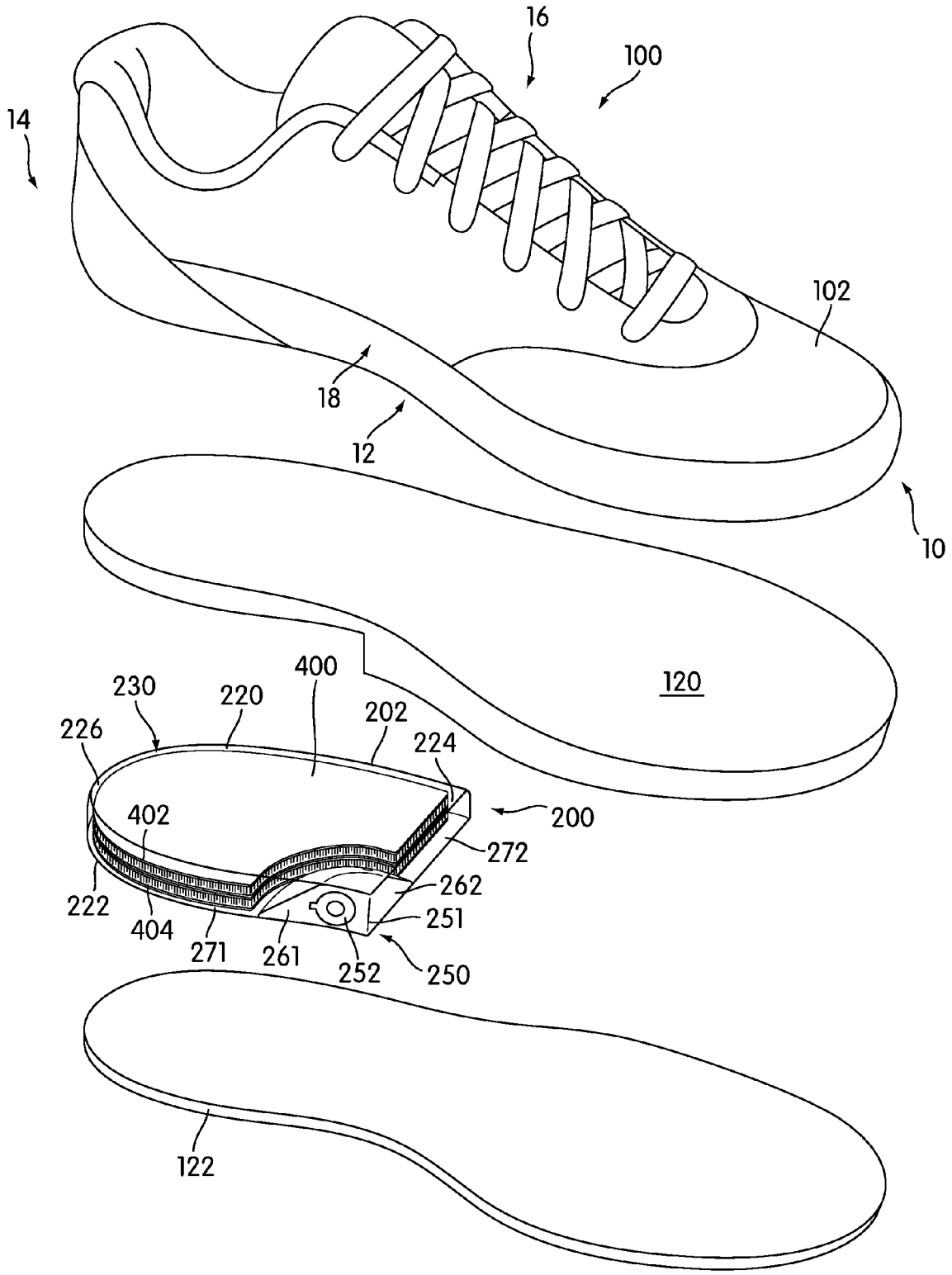
FIG. 2 an exploded isometric view of an embodiment of an article of footwear with a bladder system.

FIGS. 1 and 2 illustrate views of an exemplary embodiment of article of footwear 100, also referred to simply as article 100. For clarity, the following detailed description discusses an exemplary embodiment, in the form of a sports shoe, but it should be noted that the present embodiments could take the form of any article of footwear including, but not limited to: hiking boots, soccer shoes, football shoes, sneakers, rugby shoes, basketball shoes, baseball shoes as well as other kinds of shoes. It will be understood that the principles discussed for article of footwear 100 could be used in articles intended for use with a left and/or right foot.

Referring to FIGS. 1 and 2, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be applied to individual components of an article, such as an upper and/or a sole structure.

Article 100 can include upper 102 and sole structure 110. Generally, upper 102 may be any type of upper. In particular, upper 102 may have any design, shape, size and/or color. For example, in embodiments where article 100 is a basketball shoe, upper 102 could be a high top upper that is shaped to provide high support for an ankle. In embodiments where article 100 is a running shoe, upper 102 could be a low top upper.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional. In an exemplary embodiment, sole structure 110 may include midsole 120 and outsole 122.

In some cases, midsole 120 may be attached directly to upper 102. In other cases, midsole 120 may be attached to a sockliner associated with upper 102. In different embodiments, midsole 120 may have different material characteristics to provide various levels of comfort, cushioning and/or shock absorption. Examples of different materials that could be used for midsole 120 include, but are not limited to: foam, rubber, plastic, polymers, as well as any other kinds of materials.

In some cases, outsole 122 may be configured to provide traction for sole structure 110 and article 100. Outsole 122 can include one or more tread elements and/or ground penetrating members such as cleats. Outsole 122 can have different material characteristics to provide varying levels of traction with a ground surface. Examples of different materials that could be used for outsole 122 include, but are not limited to: plastic, rubber, polymers as well as any other kinds of materials that are both durable and wear-resistant.

A sole structure can include provisions for enhancing cushioning and shock absorption for an article of footwear. Article 100 may include bladder system 200. Various details of bladder system 200 are shown in FIGS. 1 and 2, as well as in FIGS. 3 and 4, which illustrate a bottom isometric view and an exploded isometric view, respectively, of bladder system 200.

Referring now to FIGS. 1 through 4, bladder system 200 may be disposed in any portion of article 100. In some cases, bladder system 200 may be disposed in forefoot portion 10 of sole structure 110. In other cases, bladder system 200 may be disposed in midfoot portion 12 of sole structure 110. In still other cases, bladder system 200 may be disposed in heel portion 14 of sole structure 110. In one embodiment, bladder system 200 may be disposed in heel portion 14 of sole structure 110.

Bladder system 200 may include outer bladder 202. Outer bladder 202 may comprise one or more layers that are generally impermeable to fluid. In the current embodiment, outer bladder 202 comprises upper layer 220 and lower layer 222 that are joined together at first periphery 221 and second periphery 223. Moreover, upper layer 220 and lower layer 222 comprise a boundary surface that encloses interior cavity 230.

Outer bladder 202 includes first portion 224 and second portion 226 (see FIG. 2). First portion 224 generally extends into midfoot portion 12 of sole structure 110. Second portion 226 generally extends through heel portion 14 of sole structure 110. In other embodiments, however, outer bladder 202 could include various other portions associated with any other portions of sole structure 110, including forefoot portion 10 of sole structure 110.

Bladder system 200 can include provisions for inflating outer bladder 202. In some embodiments, bladder system 200 includes valve member 250. Valve member 250 comprises a plug-like portion that supports the transfer of fluid into outer bladder 202. In some cases valve member 250 further includes valve housing 251. Valve housing 251 may include cavity 253 for receiving valve 252 and valve insert 254. Generally, valve 252 may be any type of valve that is configured to engage with an external pump of some kind. In one embodiment, valve 252 could be a Schrader valve. In another embodiment, valve 252 could be a Presta valve. In still other embodiments, valve 252 could be any other type of valve known in the art. Valve housing 251 may also include passage 255 (see FIG. 3) for transporting fluid from valve 252 to outlet port 257.

In some embodiments, valve member 250 may be substantially more rigid than outer bladder 202. This arrangement helps protect valve 252 as well as any tubing or fluid lines connected to valve 252. In other embodiments, however, the rigidity of valve member 250 could be substantially less than or equal to the rigidity of outer bladder 202. For example, in some other embodiments, valve housing 251 could be partially compressible in order to facilitate compression of bladder system 200.

Generally, valve member 250 may be provided with any geometry. In some cases, valve member 250 may have any three dimensional geometry including, but not limited to: a cuboid, a sphere, a pyramid, a prism, a cylinder, a cone, a cube, a regular three dimensional shape, an irregular three dimensional shape as well as any other kind of shape. In one embodiment, valve member 250 may comprise a truncated prism-like shape, including two approximately vertical walls as well as a third contoured wall joining at an approximately flat upper surface. In other embodiments, however, any other geometry may be utilized for valve member 250. In particular, in some embodiments the geometry of valve member 250 may be selected according to the desired overall geometry for bladder system 200.

Figure 3:
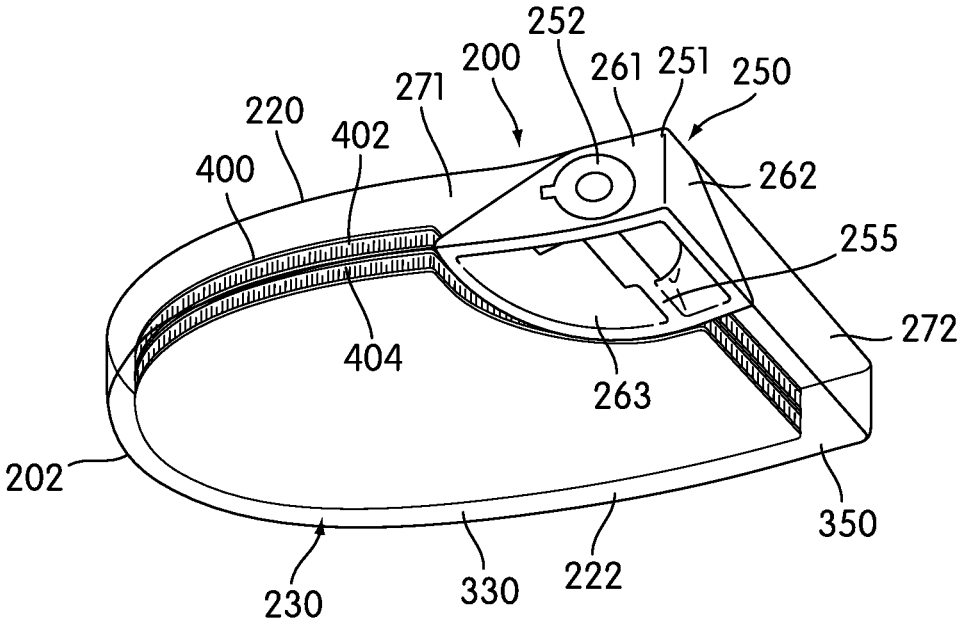
FIG. 3 is an isometric bottom view of an embodiment of a bladder system.

In some cases, valve member 250 can be disposed internally to outer bladder 202. In other cases, valve member 250 can be disposed externally to outer bladder 202. In one embodiment, valve member 250 is disposed externally to outer bladder 202. More specifically, in some cases, valve member 250 may be associated with outer surface 330 of outer bladder 202, as seen in FIG. 3. By placing valve member 250 outside of outer bladder 202, valve member 250 may not interfere with the inflation of outer bladder 202.

In some embodiments, a valve member could be associated with any portion of the outer surface of outer bladder 202. In some cases, valve member 250 could be disposed on a proximal portion of outer bladder 202. In other cases, valve member 250 could be disposed on a distal portion of outer bladder 202. In one embodiment, valve member 250 is disposed on outer surface 330 that faces outwardly from interior cavity 230. Furthermore, valve member 250 is disposed on distal portion 350 of outer surface 330. In other words, valve member 250 is disposed below outer bladder 202 and may confront a portion of outsole 122 when article 100 is assembled.

As seen in FIGS. 2 and 3, outer bladder 202 may be contoured to the shape of valve member 250. For example, in some cases, first outer surface 261 of valve member 250 may be approximately continuous with sidewall 271 of outer bladder 202. Likewise, second outer surface 262 of valve member 250 may be approximately continuous with forward wall 272 of outer bladder 202. Furthermore, in some cases, lower outer surface 263 of valve member 250 may be approximately continuous with outer surface 330 of outer bladder 202.

In different embodiments, different components of bladder system 200 may be configured with different optical properties. In some cases, outer bladder 202 may be substantially opaque. In other cases, outer bladder 202 may be substantially transparent. Likewise, in some cases, valve member 250 could be substantially opaque. In still other cases, valve member 250 could be substantially transparent. In embodiments where valve member 250 and outer bladder 202 are both opaque or both transparent, it may appear that valve member 250 and outer bladder 202 comprise a single monolithic component.

Figure 4:
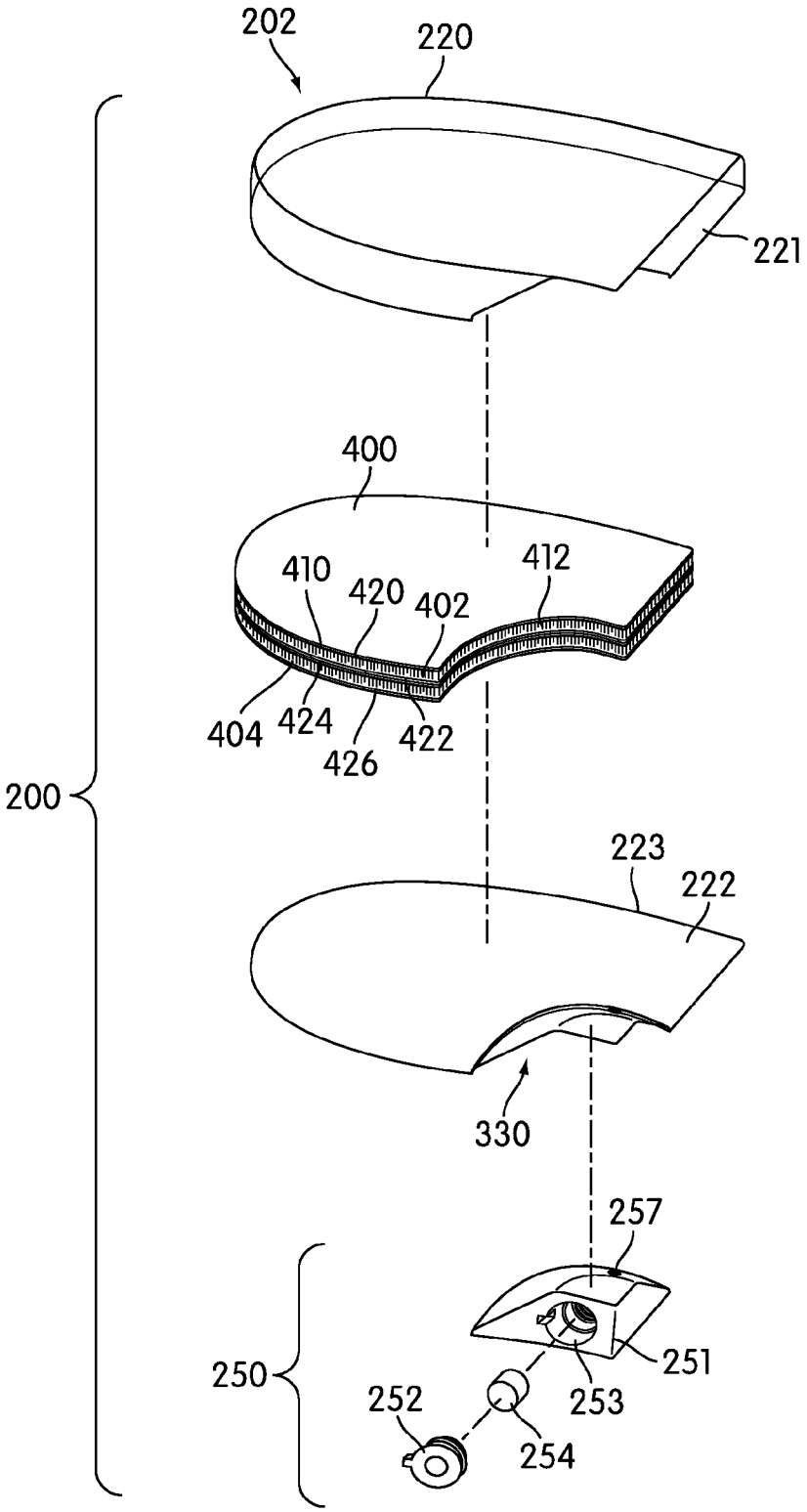
FIG. 4 is an exploded view of an embodiment of a bladder system.

Referring now to FIGS. 2 through 4, in order to provide stability and support, outer bladder 202 may be provided with a stacked tensile member 400 in some embodiments. In some cases, stacked tensile member 400 may be disposed in interior cavity 230 of outer bladder 202. Stacked tensile member 400 may comprise first tensile member 402 and second tensile member 404. First tensile member 402 and second tensile member 404 may be stacked in an approximately vertical direction (that is a direction perpendicular to both the longitudinal and lateral directions of article 100).

Referring to FIG. 4, first tensile member 402 and second tensile member 404 may be spaced textiles (or spacer-knit textiles). In particular, each first tensile member 402 may include textile layers 410 as well as connecting members 412 that extend between the textile layers 410. For example, first tensile member 402 includes first textile layer 420 and second textile layer 422, while second tensile member 404 includes third textile layer 424 and fourth textile layer 426. In some cases, first textile layer 420 may be attached to upper layer 220 of outer bladder 202. Additionally, in some cases, fourth textile layer 426 may be attached to lower layer 222 of outer bladder 202. Furthermore, in some cases, second textile layer 422 and third textile layer 424 may be attached to one another to join first tensile member 402 and second tensile member 404.

In some embodiments, first tensile member 402 could be substantially similar to second tensile member 404. In other embodiments, however, first tensile member 402 could differ from second tensile member 404 in size, shape, material characteristics as well as any other features. In the current embodiment, first tensile member 402 may share substantially similar material and structural properties to second tensile member 404. In addition, first tensile member 402 may have a substantially similar geometry to second tensile member 404.

Using this arrangement, first tensile member 402 and second tensile member 404 may provide structural reinforcement for outer bladder 202. In particular, as a compression force is applied to outer bladder 202 (such as during heel contact with a ground surface) the outward force of fluid puts connecting members 412 in tension. This acts to prevent further outward movement of textile layers 410 and thereby prevents further outward movement of outer bladder 202. This arrangement helps to control the deformation of outer bladder 202, which might otherwise be fully compressed during heel strikes with a ground surface. In particular, by varying the internal pressure of outer bladder 202, as well as the structural properties of stacked tensile member 400, the range of deformation of outer bladder 202 can be tuned to provide maximum support, stability and energy return during use of an article of footwear.

Examples of different configurations for a bladder including tensile members are disclosed in Swigart, now U.S. application Ser. No. 12/938,175, filed Nov. 2, 2010, the entirety of which is hereby incorporated by reference. Further examples are disclosed in Dua, now U.S. application Ser. No. 12/123,612, and Rapaport et al., now U.S. application Ser. No. 12/123,646, the entirety of both being hereby incorporated by reference. An example of configurations for tensile members manufactured using a flat-knitting process is disclosed in Dua, now U.S. application Ser. No. 12/123,612, the entirety of which is hereby incorporated by reference.

Figure 5:
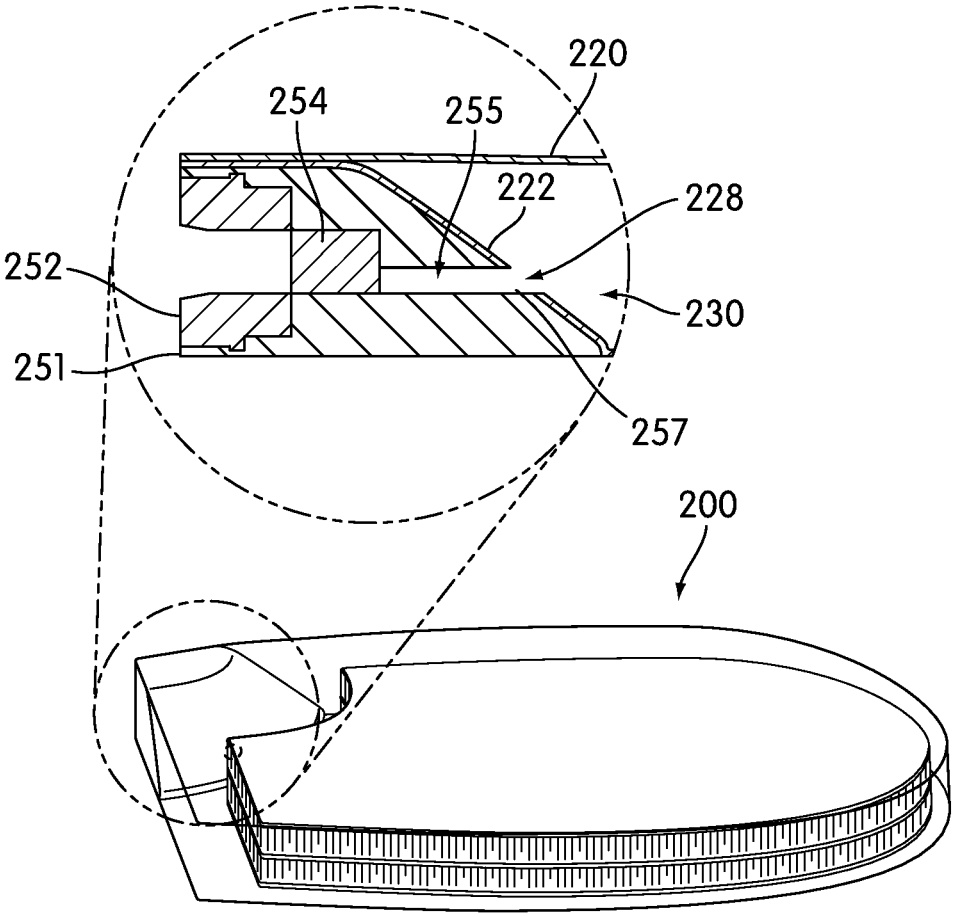
FIG. 5 is an enlarged cross-sectional view of an embodiment of a valve arrangement for a bladder system.

FIG. 5 illustrates an enlarged cross-sectional view of an embodiment of a portion of bladder system 200. Referring to FIG. 5, fluid may be pumped into outer bladder 202 by engaging an external pump with valve 252. Fluid entering through valve 252 may be transported through valve insert 254 and into passage 255. In some cases, lower layer 222 may include hole 228 that allows fluid to flow from passage 255 into interior cavity 230 of outer bladder 202.

This arrangement may help increase the durability of bladder system 200 and reduce the likelihood of leaking. In particular, in contrast to bladder systems utilizing internal valves that are exposed along an outer surface of the bladder, the connection between outlet port 257 and hole 228 of lower layer 222 is protected by valve housing 251. Moreover, in contrast to embodiments where a wider valve is exposed through a hole in an outer bladder, this configuration allows for a smaller perforation in outer bladder 202, since the fluid connection occurs at the outlet side of the valve.

Figure 6:
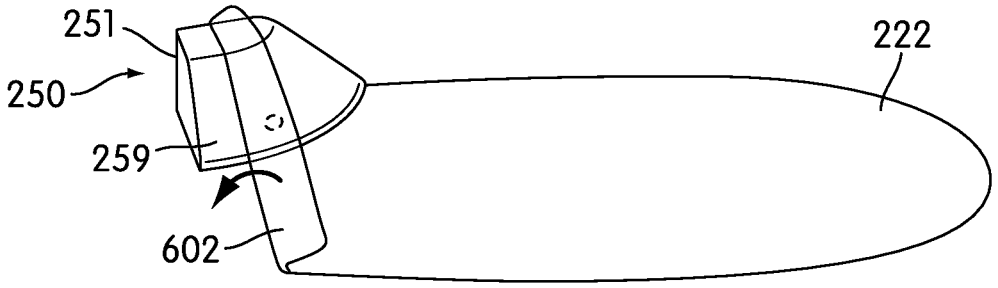
FIG. 6 is an embodiment of a step in a process of making a bladder system.

FIGS. 6 through 9 illustrate an embodiment of a process for making bladder system 200. Referring to FIG. 6, lower layer 222 may be attached to valve member 250. Specifically, first side 602 of lower layer 222 may be joined to outer surface 259 of valve housing 251. In different embodiments, the method of joining lower layer 222 and valve member 250 could vary. In some cases, for example, an adhesive may be used to attach lower layer 222 to valve member 250. In other cases, lower layer 222 and valve member 250 could be joined together using heat. In still other cases, any other methods for joining lower layer 222 and valve member 250 known in the art could be used. In an embodiment where lower layer 222 and valve member 250 both comprise a plastic material, such as TPU, lower layer 222 and valve member 250 could be bonded together using heat and/or pressure. In one embodiment, lower layer 222 may be overmolded onto valve member 250 using any known overmolding techniques known in the art.

Figure 7:
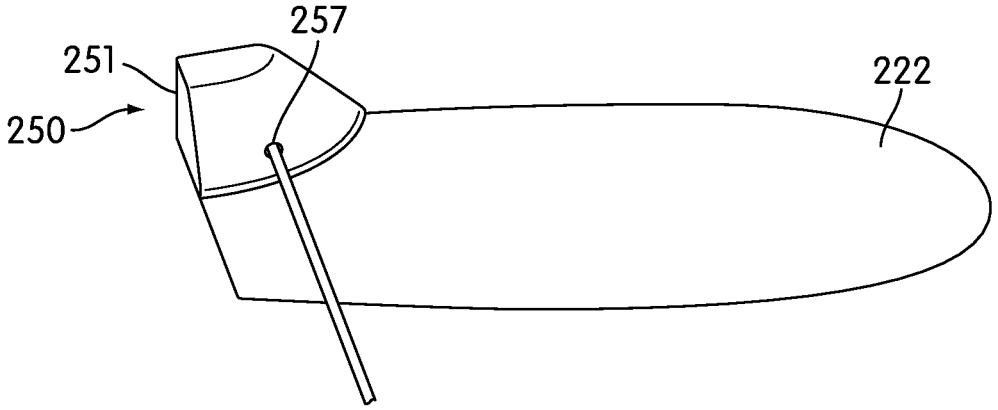
FIG. 7 is an embodiment of a step in a process of making a bladder system.

Referring now to FIG. 7, once lower layer 222 has been attached to valve member 250, lower layer 222 may be punctured at a location corresponding to outlet port 257 of valve housing 251. This can be accomplished using any device capable of puncturing lower layer 222. It will be understood that in still other embodiments, lower layer 222 may be provided with a preformed hole that is configured to align with outlet port 257 before assembly.

Figure 8:
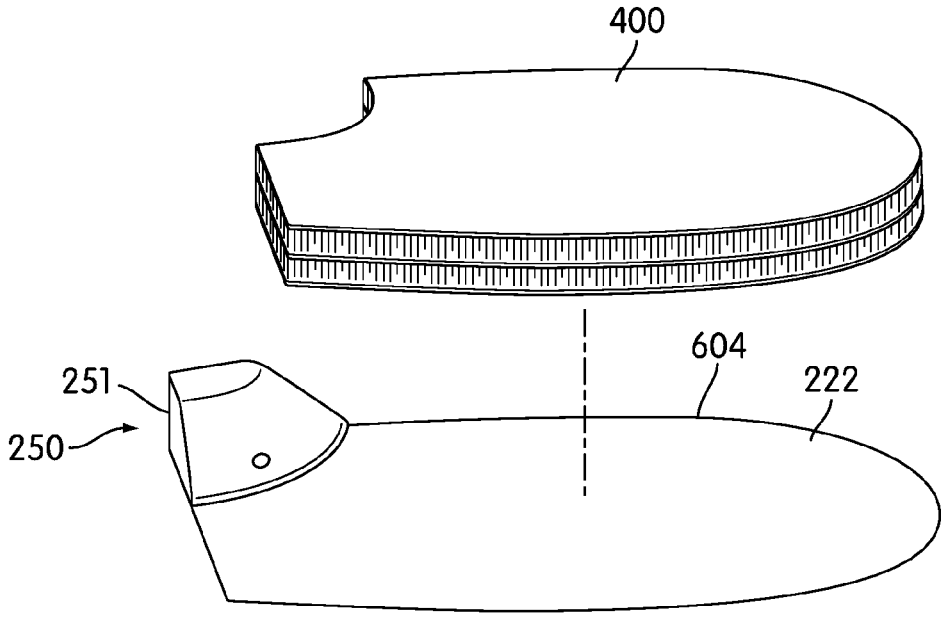
FIG. 8 is an embodiment of a step in a process of making a bladder system.
Figure 9:
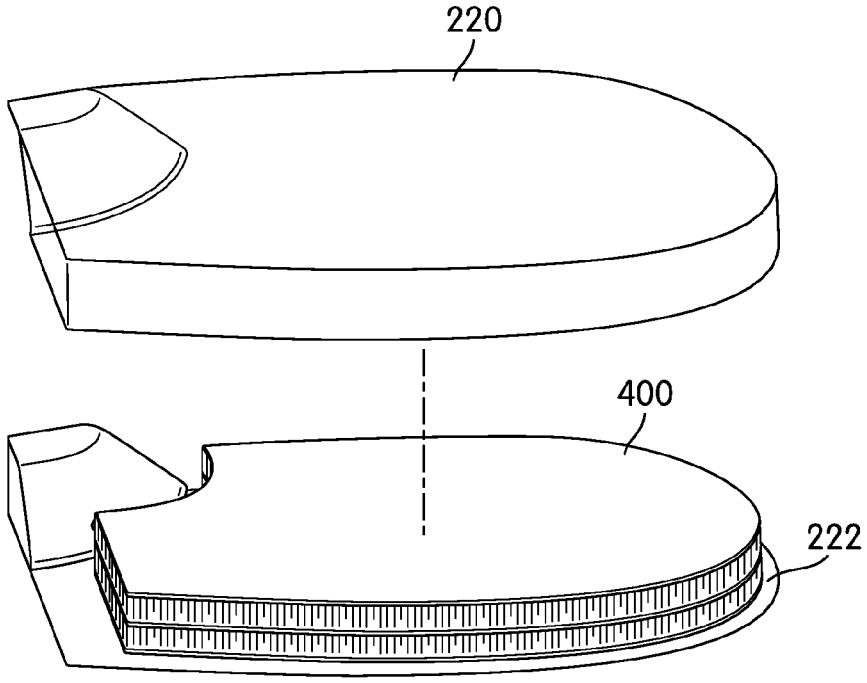
FIG. 9 is an embodiment of a step in a process of making a bladder system.

Referring to FIG. 8, stacked tensile member 400 may be laid onto lower layer 222. In particular, stacked tensile member 400 may be associated with second side 604 of lower layer 222. Next, as seen in FIG. 9, upper layer 220 may be placed over stacked tensile member 400. At this point, lower layer 222 and upper layer 220 may be joined together using any method known in the art in order to form an interior chamber. In one embodiment, upper layer 220 and lower layer 222 may be thermoformed together to permanently join upper layer and lower layer 222, thereby forming an interior cavity around stacked tensile member 400. For example, in some cases, a first periphery of lower layer 222 may be thermoformed with a second periphery of upper layer 220. In embodiments where excess material occurs after thermoforming, the excess material could be removed to form a substantially smooth outer surface for outer bladder 202.

In some cases, prior to joining lower layer 222 and upper layer 220, one or more portions of stacked tensile member 400 can be attached to lower layer 222 and/or upper layer 220. For example, in some cases, a first textile layer of stacked tensile member 400 can be attached directly to lower layer 222, while a second textile layer can be attached directly to upper layer 220. This arrangement may prevent movement of stacked tensile member 400 inside outer bladder 202 and may help restrict compression of outer bladder 202.

It will be understood that the steps illustrated in FIGS. 6 through 9 are only intended to be exemplary and in other embodiments, various other steps could be incorporated into the process. For example, each of the lower layer 222 and upper layer 220 could be shaped during assembly, or could be shaped before assembly into a desired geometry. For example, portions of both or either upper layer 220 and lower layer 222 could be contoured to fit against valve member 250. Likewise, the peripheries of each layer could be contoured so that lower layer 222 and upper layer 220 can be more easily joined together during the assembly process.

Figure 10:
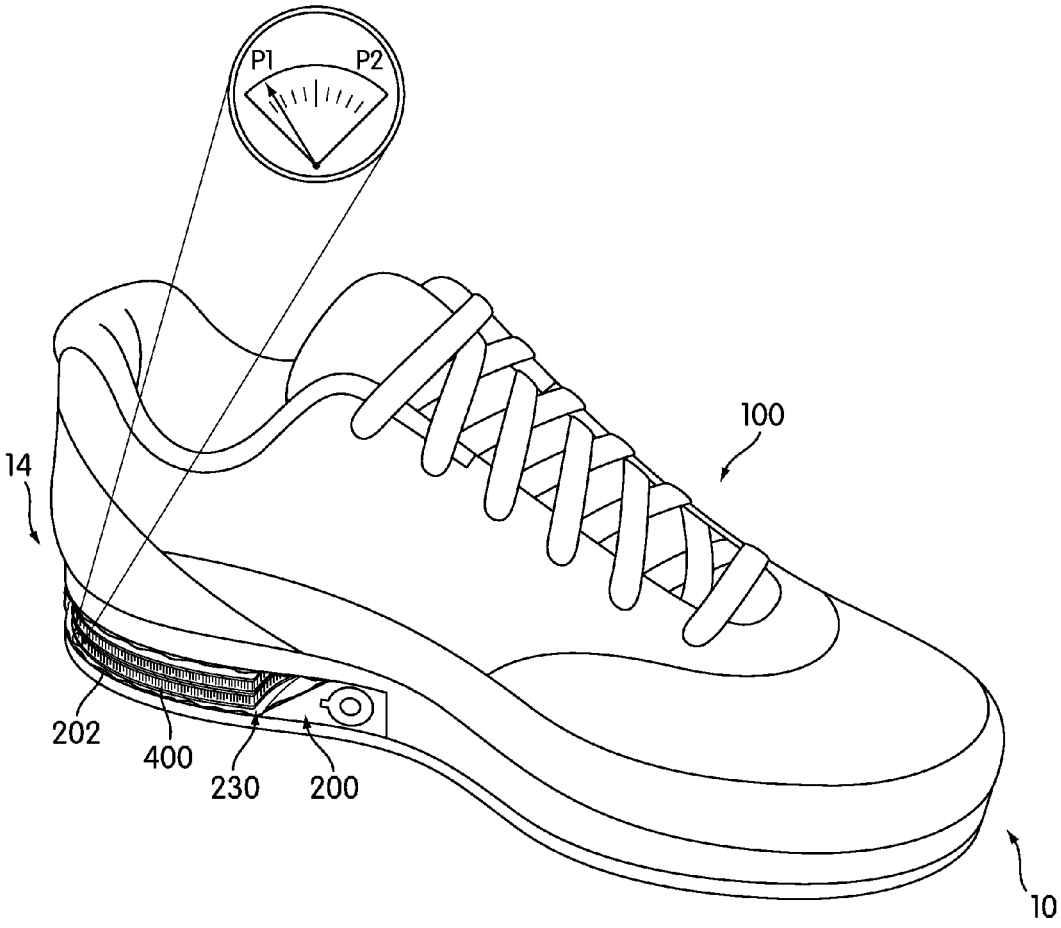
FIG. 10 is an isometric view of an embodiment of an article of footwear with a bladder system in a partially inflated state.
Figure 11:
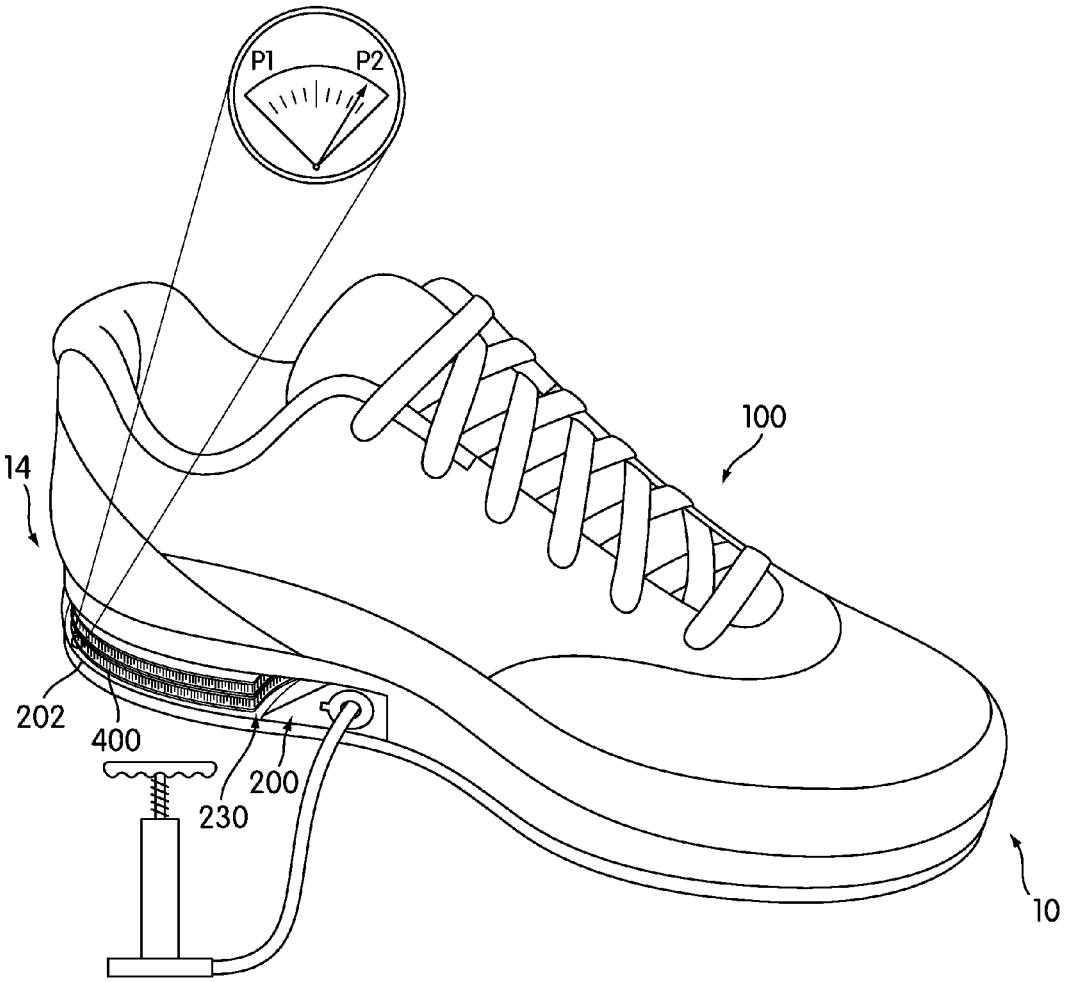
FIG. 11 is an isometric view of an embodiment of article of footwear with a bladder system in a fully inflated state.

FIGS. 10 and 11 illustrate embodiments of bladder system 200 in a partially inflated state and a fully inflated state. Referring to FIG. 10, outer bladder 202 is in a partially inflated state. In this case, interior cavity 230 has internal pressure P1, indicated schematically in this Figure. Although outer bladder 202 is only partially inflated, the presence of stacked tensile member 400 prevents outer bladder 202 from deforming substantially under forces applied by a foot within article 100.

Referring now to FIG. 11, outer bladder 202 is in a fully inflated state. In this case, interior cavity 230 has an internal pressure P2 that is substantially greater than internal pressure P1. Although the pressure of outer bladder 202 has substantially increased, the overall shape of outer bladder 202 is approximately unchanged between the partially inflated and fully inflated states. This arrangement helps maintain a gradual transition between the cushioned heel portion 14 and the non-cushioning forefoot portion 10 of article 100.

It should be understood that the approximate shapes and dimensions for outer bladder 202 discussed above may be maintained even when compressive forces are applied to outer bladder 202 by a foot and a ground surface. In particular, the shape and volumes of outer bladder 202 and valve member 250 may remain substantially constant regardless of the internal pressure of outer bladder 202. Therefore, compressive forces applied to outer bladder 202 may not substantially change the sizes and shapes of outer bladder 202 and valve member 250.

Figure 12:
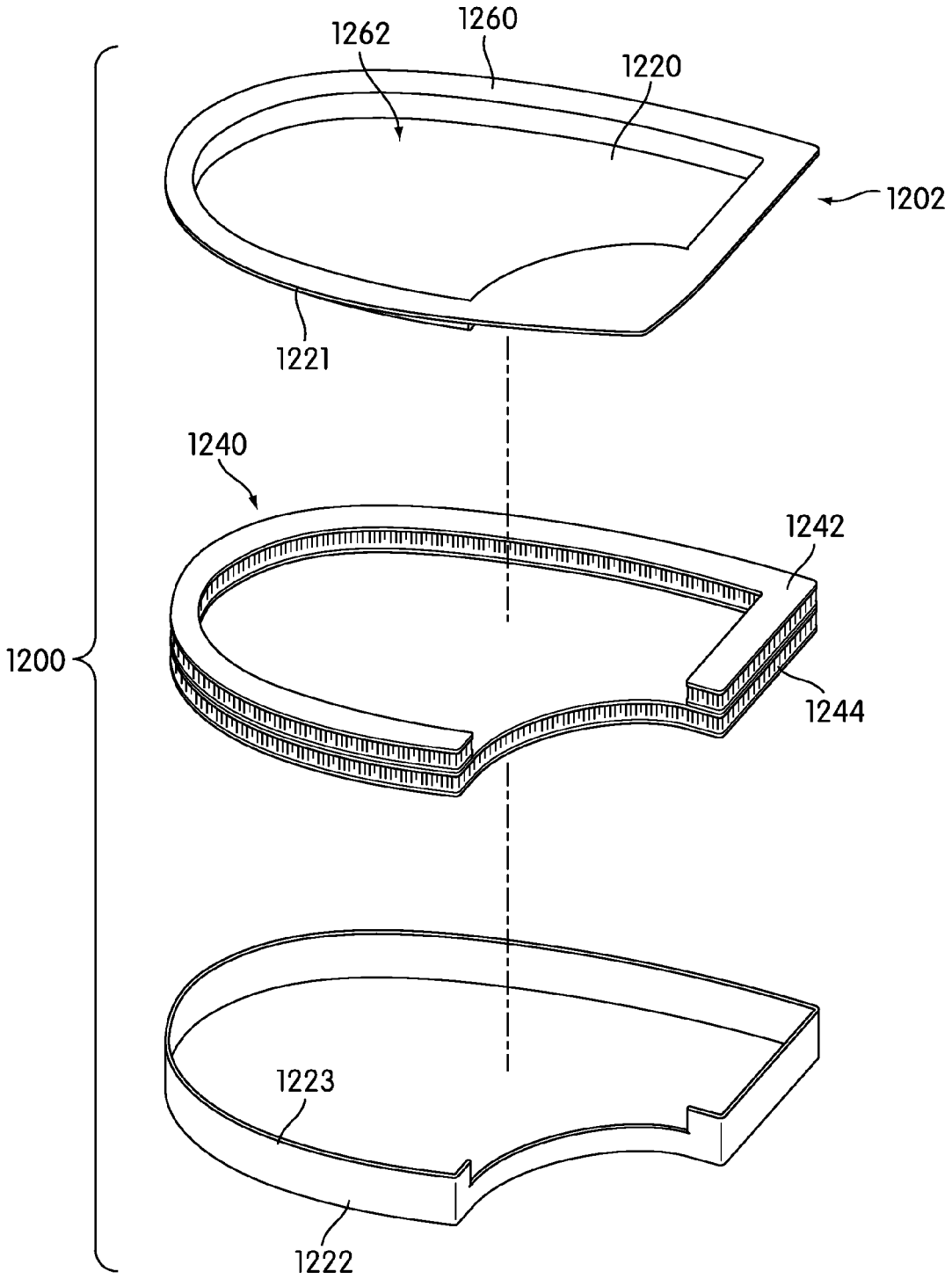
FIG. 12 is an alternative embodiment of a bladder system with a contoured shape.

In different embodiments, the shape of various components of a bladder system could vary. FIG. 12 illustrates an isometric view of an alternative embodiment for bladder system 1200. Referring to FIG. 12, bladder system 1200 may include outer bladder 1202. Outer bladder 1202 may comprise one or more layers that are generally impermeable to fluid. In the current embodiment, outer bladder 1202 comprises upper layer 1220 and lower layer 1222 that are joined together at first periphery 1221 and second periphery 1223. Moreover, upper layer 1220 and lower layer 1222 comprise a boundary surface that encloses an interior cavity.

Bladder system 1200 further includes stacked tensile member 1240. Stacked tensile member 1240 comprises first tensile member 1242 and second tensile member 1244. Second tensile member 1244 comprises a substantially flat tensile member. In addition, first tensile member 1242 extends only along the perimeter of second tensile member 1244. This arrangement helps provide structural support for the contoured shape of outer bladder 1202 that comprises a raised outer perimeter 1260 and a sunken or recessed central portion 1262.

Figure 13:
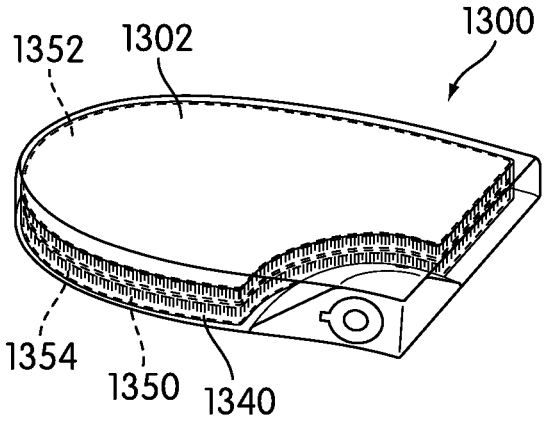
FIG. 13 is an isometric view of an embodiment of a bladder system including an outer bladder and an inner bladder.

Referring to FIG. 13, in some embodiments, bladder system 1300 may include one or more inner bladders disposed within outer bladder 1302. In the current embodiment, bladder system 1300 includes inner bladder 1340. Although a single inner bladder is used in the current embodiment, other embodiments could include two or more inner bladders. In embodiments where multiple inner bladders are used, the inner bladders could be arranged within an outer bladder in any configuration. In some cases, for example, multiple inner bladders could be stacked vertically within an outer bladder.

Generally, an inner bladder may be any type of bladder. In some cases, an inner bladder may be an inflatable bladder. In other cases, an inner bladder may not be inflatable. In other words, in some cases, the amount of fluid within the inner bladder may be fixed. In one embodiment, an inner bladder may be a sealed bladder with an approximately constant pressure. In particular, in some cases, the pressure of the inner bladder may be set at the time of manufacturing.

Examples of different types of bladders that could be used as inner bladders can be found in U.S. Pat. Nos. 6,119,371 and 5,802,738, both of which are hereby incorporated by reference. Moreover, the properties of one or more inner bladders could vary. Some may include internal structures that enhance support and maintain resiliency for the bladders. Other inner bladders may comprise a single outer layer that encloses an interior cavity. In still other embodiments, one or more inner bladders could have any other material and/or structural properties.

As seen in FIG. 13, in one embodiment, inner bladder 1340 comprises a contoured envelope enclosing stacked tensile member 1350. Stacked tensile member 1350 may include textile layers 1352 and connecting members 1354 in a substantially similar configuration to the stacked tensile members discussed in earlier embodiments. This arrangement provides a dual cushioning system in which outer bladder 1302 and inner bladder 1340 both provide fluid support. Moreover, stacked tensile member 1350 provides reinforcement to control the amount of compression in outer bladder 1302 and inner bladder 1340.

In different embodiments, the relative pressures of one or more bladders could vary. In one embodiment, inner bladder 1340 may be configured with substantially different internal pressures from outer bladder 1302. For example, in one embodiment, inner bladder 1340 could have an internal pressure that is substantially greater than the maximum inflation pressure of outer bladder 1302. In other words, in some cases, the pressure of outer bladder 1302 may not be increased above the internal pressures of inner bladder 1340. Using this arrangement, inner bladder 1340 may be substantially stiffer than outer bladder 1302.

It will be understood that in other embodiments, the relative internal pressures of each bladder could vary. In other embodiments, for example, inner bladder 1340 could have an internal pressure substantially equal to or less than the maximum inflation pressure associated with outer bladder 1302.

Using the arrangement discussed here, inner bladder 1340 may provide structural support for outer bladder 1302. In particular, inner bladder 1340 may help maintain a substantially constant shape for outer bladder 1302 regardless of the inflation pressure of outer bladder 1302. This allows a user to adjust the pressure of outer bladder 1302 without substantially varying the shape of outer bladder 1302. Furthermore, this arrangement allows a user to adjust the pressure of outer bladder 1302 without changing the height of heel portion 14 of article 100.

It will be understood that while a single inner bladder is used in the current embodiment, other embodiments can include any number of inner bladders. In another embodiment, two inner bladders could be used. In still another embodiment, three or more inner bladders could be used. In addition, multiple bladders could be stacked or combined in any manner to provide structural support for one or more portions of an outer bladder.

Figure 14:
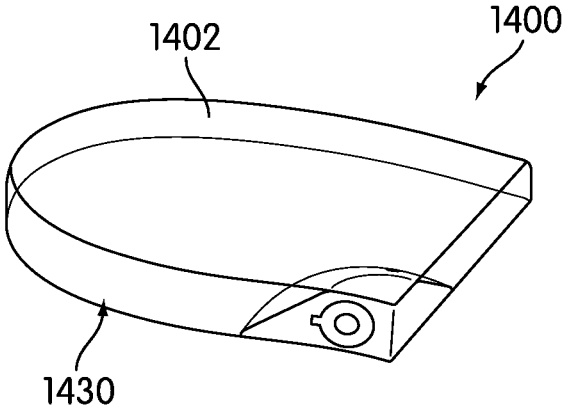
FIG. 14 is an isometric view of an alternative embodiment of a bladder system.

FIG. 14 illustrates an isometric view of an alternative embodiment of a bladder system 1400. Referring to FIG. 14, in some cases bladder system 1400 may be provided without a stacked tensile member. In other words, interior cavity 1430 of outer bladder 1402 may be substantially empty. In still other cases, however, any other pads, bladders, foams, fluids, tensile members or any other components could be disposed within interior cavity 1430 in order to control compression of outer bladder 1402.

Figure 15:
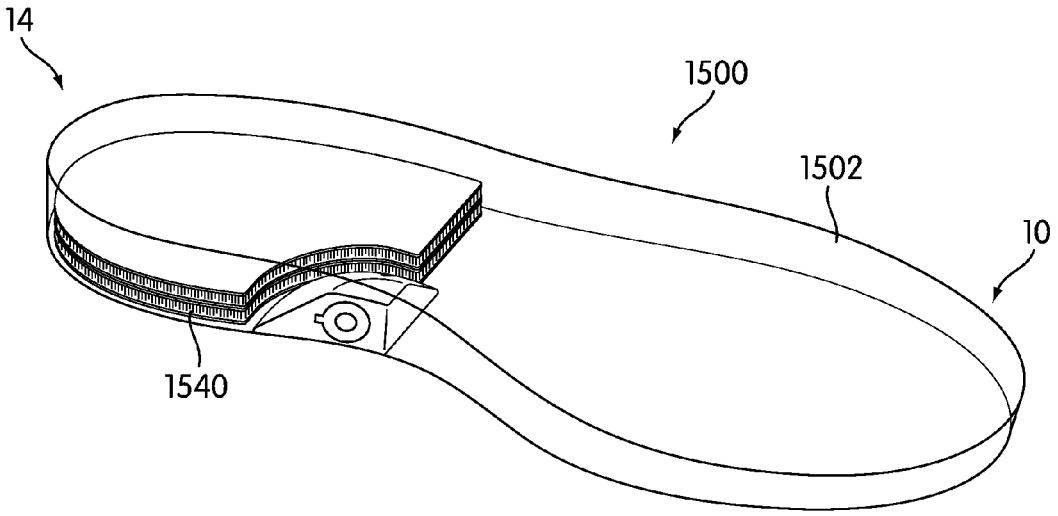
FIG. 15 is an isometric view of an embodiment of a full length bladder system.

FIG. 15 illustrates an isometric view of an embodiment of full length bladder system 1500. In some cases, to enhance support along the length of an article of footwear (in both the forefoot and heel regions, for example) outer bladder 1502 may be a full length bladder. In addition, stacked tensile member 1540 may be provided in heel portion 14 in order to control compression of outer bladder 1502 at heel portion 14. In some cases, forefoot portion 10 of outer bladder 1502 may not include any tensile members. This arrangement provides for differential cushioning along the length of an article as heel portion 14 may be stiffer than forefoot portion 10.

Outer bladders and/or inner bladders can be filled with any type of fluid. In some cases, a bladder can be configured to receive a gas including, but not limited to: air, hydrogen, helium, nitrogen or any other type of gas including a combination of any gases. In other cases, the bladder can be configured to receive a liquid, such as water or any other type of liquid including a combination of liquids. In an exemplary embodiment, a fluid used to fill a bladder can be selected according to desired properties such as compressibility. For example, in cases where it is desirable for a bladder to be substantially incompressible, a liquid such as water could be used to fill the inflatable portion. Also, in cases where it is desirable for a bladder to be partially compressible, a gas such as air could be used to fill the inflatable portion.

Materials that may be useful for forming the outer walls of an outer bladder can vary. In some cases, an outer bladder may be comprised of a rigid to semi-rigid material. In other cases, an outer bladder may be comprised of a substantially flexible material. Outer bladders may be made of various materials in different embodiments. In some embodiments, outer bladders can be made of a substantially flexible and resilient material that is configured to deform under fluid forces. In some cases, outer bladders can be made of a plastic material. Examples of plastic materials that may be used include high density polyvinyl-chloride (PVC), polyethylene, thermoplastic materials, elastomeric materials as well as any other types of plastic materials including combinations of various materials. In embodiments where thermoplastic polymers are used for a bladder, a variety of thermoplastic polymer materials may be utilized for the bladder, including polyurethane, polyester, polyester polyurethane, and polyether polyurethane. Another suitable material for a bladder is a film formed from alternating layers of thermoplastic polyurethane and ethylene-vinyl alcohol copolymer, as disclosed in U.S. Pat. Nos. 5,713,141 and 5,952,065 to Mitchell et al., hereby incorporated by reference. A bladder may also be formed from a flexible microlayer membrane that includes alternating layers of a gas barrier material and an elastomeric material, as disclosed in U.S. Pat. Nos. 6,082,025 and 6,127,026 to Bonk et al., both hereby incorporated by reference. In addition, numerous thermoplastic urethanes may be utilized, such as PELLETHANE, a product of the Dow Chemical Company; ELASTOLLAN, a product of the BASF Corporation; and ESTANE, a product of the B.F. Goodrich Company, all of which are either ester or ether based. Still other thermoplastic urethanes based on polyesters, polyethers, polycaprolactone, and polycarbonate macrogels may be employed, and various nitrogen blocking materials may also be utilized. Additional suitable materials are disclosed in U.S. Pat. Nos. 4,183,156 and 4,219,945 to Rudy, hereby incorporated by reference. Further suitable materials include thermoplastic films containing a crystalline material, as disclosed in U.S. Pat. Nos. 4,936,029 and 5,042,176 to Rudy, hereby incorporated by reference, and polyurethane including a polyester polyol, as disclosed in U.S. Pat. Nos. 6,013,340; 6,203,868; and 6,321,465 to Bonk et al., also hereby incorporated by reference. In an exemplary embodiment, outer bladder 202 may be comprised one or more layers of thermoplastic-urethane (TPU).

In different embodiments, the materials used for making inner bladders can also vary. In some cases, materials used for inner bladders can be substantially similar to the materials used for outer bladders, including any of the materials discussed above. In other cases, however, inner bladders could be made of substantially different materials from outer bladders.

In still other embodiments, an outer bladder can be filled with any other kind of structures that provide support and enhance the operation of a bladder system. Although the current embodiments show systems including tensile members, other embodiments could include any other kinds of support structures that can be placed inside a bladder. One example of a bladder with various kinds of support structures is disclosed in Peyton et al., now U.S. application Ser. No. 12/630,642, filed Dec. 3, 2009, the entirety of which is hereby incorporated by reference. Another example is disclosed in Peyton, now U.S. application Ser. No. 12/777,167, filed May 10, 2010, the entirety of which is hereby incorporated by reference. An example of a bladder incorporating a foam tensile member is disclosed in Schindler, U.S. Pat. No. 7,131,218, the entirety of which is hereby incorporated by reference.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A bladder system for an article of footwear, comprising:

an outer bladder bounding an interior cavity;

the outer bladder having a forward first portion, a rearward second portion, a medial side, and a lateral side;

the outer bladder including an upper layer and a lower layer, the lower layer including an outer surface facing outwardly from the interior cavity;

a valve member including a housing, a valve, an outlet port and a fluid passage extending between the valve and the outlet port;

the housing having a truncated prism-like shape with a forward substantially-vertical wall, a medial substantially-vertical wall, a contoured wall extending between the forward substantially-vertical wall and the medial substantially-vertical wall, and a substantially-flat upper surface, wherein the forward substantially-vertical wall, the medial substantially-vertical wall, and the contoured wall join at the substantially-flat upper surface;

the outer surface of the lower layer being attached to the contoured wall and the substantially-flat upper surface of the housing of the valve member; and wherein a hole in the lower layer is aligned with the outlet port of the valve member.

2. The bladder system according to claim 1, further comprising the article of footwear;

wherein the article of footwear comprises an upper and an outsole;

wherein the outer bladder is disposed between the upper and the outsole; and wherein the outer surface of the lower layer is disposed against the outsole.

3. The bladder system according to claim 1, wherein the bladder system includes a tensile member disposed in the interior cavity.

4. The bladder system according to claim 3, wherein the tensile member is a stacked tensile member including a first tensile member and a second tensile member.

5. The bladder system according to claim 4, wherein the first tensile member is attached to the upper layer and wherein the second tensile member is attached to the lower layer.

6. The bladder system according to claim 5, wherein the bladder system further includes a fluid disposed inside the interior cavity and wherein the fluid is pressurized to place an outward force upon the outer bladder and induce tension in the stacked tensile member.

7. The bladder system according to claim 1, wherein the contoured wall has a curved base and is inclined toward the substantially-flat upper surface.

8. The bladder system according to claim 4, wherein the overall shape and size of the first tensile member are substantially similar to the overall shape and size of the second tensile member.

9. The bladder system according to claim 4, wherein the shape of the first tensile member is substantially different from the shape of the second tensile member.

10. The bladder system of claim 1, wherein the valve is disposed at the medial substantially-vertical wall of the housing;

wherein the outlet port is disposed at the contoured wall of the housing; and wherein the housing is disposed at a corner of the outer bladder at the forward first portion and the medial side of the outer bladder.

11. A bladder system for an article of footwear, comprising:

an outer bladder bounding an interior cavity;

the outer bladder including an upper layer and a lower layer, the lower layer including an outer surface facing outwardly from the interior cavity;

a stacked tensile member including a plurality of textile layers and a plurality of connecting members;

a valve member configured to deliver fluid to the interior cavity;

the stacked tensile member being disposed inside the interior cavity;

wherein the valve member is associated with the outer surface;

wherein the stacked tensile member includes a first tensile member and a second tensile member, the first tensile member including a first textile layer and a second textile layer and the second tensile member including a third textile layer and a fourth textile layer; and wherein the shape of the first tensile member is substantially different from the shape of the second tensile member.

12. The bladder system according to claim 11, wherein the first textile layer is attached to the upper layer of the outer bladder.

13. The bladder system according to claim 11, wherein the fourth textile layer is attached to the lower layer of the outer bladder.

14. The bladder system according to claim 11, wherein the second textile layer is attached to the third textile layer.

15. The bladder system according to claim 11, wherein the bladder system further includes a fluid disposed inside the interior cavity and wherein the fluid is pressurized to place an outward force upon the outer bladder and induce tension in the stacked tensile member.

16. A method of making a bladder system, comprising:

attaching a first side of a lower layer to a valve member, the valve member including a housing, a valve, an outlet port, and a fluid passage extending between the valve and the outlet port, wherein the housing has a truncated prism-like shape with a forward substantially-vertical wall, a medial substantially-vertical wall, a contoured wall extending between the forward substantially-vertical wall and the medial substantially-vertical wall, and a substantially-flat upper surface, wherein the forward substantially-vertical wall, the medial substantially-vertical wall, and the contoured wall join at the substantially-flat upper surface, wherein the valve is disposed at the medial substantially-vertical wall of the housing, wherein the outlet port is disposed at the contoured wall of the housing, and wherein the first side of the lower layer is attached to the contoured wall and the substantially-flat upper surface of the housing;

forming a hole in the lower layer corresponding to the outlet port of the valve member;

associating a tensile member with a second side of the lower layer, the second side being disposed opposite of the first side;

associating an upper layer with the lower layer; and attaching the upper layer and the lower layer in a manner that forms a pressurized interior cavity and enclosing the tensile member within the interior cavity.

17. The method according to claim 16, wherein associating the tensile member with the second side of the lower layer includes attaching a textile layer of the tensile member to the second side.

18. The method according to claim 16, wherein associating the upper layer with the lower layer includes joining a first periphery of the upper layer with a second periphery of the second layer.

19. The method according to claim 16, wherein the tensile member is a stacked tensile member;

wherein the stacked tensile member includes a first tensile member and a second tensile member, the first tensile member including a first textile layer and a second textile layer and the second tensile member including a third textile layer and a fourth textile layer; and wherein the shape of the first tensile member is substantially different from the shape of the second tensile member.

20. The method according to claim 16, wherein attaching the first side of the lower layer to the valve member includes heating the lower layer and the valve member in order to bond the lower layer to the valve member.

21. The method according to claim 16, wherein the outer bladder is inflated by attaching an external pump to the valve.

22. A method of making a bladder system, comprising:

attaching a first side of a lower layer to a valve member, the valve member including a housing, a valve, an outlet port, and a fluid passage extending between the valve and the outlet port, wherein the lower layer has a forward first portion, a rearward second portion, a medial side, and a lateral side, wherein the housing has a forward substantially-vertical wall at the forward first portion of the lower layer, a medial substantially-vertical wall at the medial side of the lower layer, a contoured wall extending between the forward substantially-vertical wall and the medial substantially-vertical wall, and a substantially-flat upper surface, wherein the forward substantially-vertical wall, the medial substantially-vertical wall, and the contoured wall join at the substantially-flat upper surface, wherein the valve is disposed at the medial substantially-vertical wall of the housing, wherein the outlet port is disposed at the contoured wall of the housing, and wherein the first side of the lower layer is attached to the contoured wall and the substantially-flat upper surface of the housing;

forming a hole in a portion of the lower layer attached to the contoured wall and corresponding to the outlet port of the valve member;

associating an upper layer with the second side of the lower layer;

joining a first periphery of the lower layer with a second periphery of the upper layer so as to form a pressurized interior cavity; and wherein the valve member is disposed outside of the interior cavity.

23. The method according to claim 22, wherein attaching the first side of the lower layer to the valve member includes overmolding the lower layer onto the contoured wall and the substantially-flat upper surface of the housing of the valve member.

24. The method according to claim 22, wherein joining the first periphery to the second periphery comprises thermoforming the first periphery to the second periphery.

25. The method according to claim 22, wherein attaching the lower layer to the valve member is followed by associating a stacked tensile member with the second side of the lower layer;

wherein the stacked tensile member includes a first tensile member and a second tensile member, the first tensile member including a first textile layer and a second textile layer and the second tensile member including a third textile layer and a fourth textile layer; and wherein the shape of the first tensile member is substantially different from the shape of the second tensile member.

26. The method according to claim 25, wherein the stacked tensile member is enclosed by the lower layer and the upper layer.

27. The method according to claim 25, wherein the lower layer and the upper layer are polymer layers.

28. The method according to claim 25, wherein the lower layer and the upper layer are substantially transparent layers.

29. A method of making a bladder system, comprising:

attaching a first side of a lower layer to a valve member, the valve member including a valve and an outlet port;

forming a hole in the lower layer corresponding to the outlet port of the valve member;

associating a stacked tensile member with a second side of the lower layer that is disposed opposite of the first side, wherein the stacked tensile member includes a first tensile member and a second tensile member, and wherein the shape of the first tensile member is substantially different from the shape of the second tensile member;

attaching a first textile layer of the first tensile member to the lower layer;

attaching an upper layer to a second textile layer of the tensile member; and attaching the lower layer and the upper layer in a manner that forms a pressurized interior cavity and wherein the stacked tensile member is disposed inside the interior cavity.

30. The method according to claim 29, wherein the stacked tensile member includes a third textile layer and a fourth textile layer attached to the third textile layer.

31. The method according to claim 29, wherein a plurality of connecting members join the first textile layer to the third textile layer.

32. The method according to claim 30, wherein a plurality of connecting members join the second textile layer to the fourth textile layer.

33. The method according to claim 29, wherein the lower layer and the upper layer are attached using heat.

34. The method according to claim 29, wherein the lower layer is attached to the valve member using heat.

35. The method according to claim 29, wherein the lower layer and a valve housing of the valve member are made of the same material.

36. The method according to claim 29, wherein the bladder system is disposed in a heel portion of a sole structure.

* * * * *